US006799538B2

(12) United States Patent
Lim

(10) Patent No.: US 6,799,538 B2
(45) Date of Patent: Oct. 5, 2004

(54) HEATING APPARATUS USING USELESS HEAT FOR REDUCING OIL

(76) Inventor: Jung-soo Lim, 265-3, Taepyeong-1-Dong, Jung-Gu, Daejeon (KR)

( * ) Notice: Subject to any disclaimer, the term of this patent is extended or adjusted under 35 U.S.C. 154(b) by 0 days.

(21) Appl. No.: 10/446,426

(22) Filed: May 28, 2003

(65) Prior Publication Data

US 2003/0205209 A1 Nov. 6, 2003

Related U.S. Application Data

(63) Continuation-in-part of application No. PCT/KR01/02050, filed on Nov. 27, 2001.

(51) Int. Cl.[7] ..... F22B 37/02
(52) U.S. Cl. ..... 122/7 R; 122/20 B; 122/421
(58) Field of Search ..... 122/7 R, 20 B, 122/155.2, 44.2, 421; 237/19, 55, 12.1

(56) References Cited

U.S. PATENT DOCUMENTS 1,489,501 A * 4/1924 Miner, Jr. ..... 237/12.1
2,005,224 A * 6/1935 Dunham et al. ..... 237/2 R
4,401,261 A * 8/1983 Brown ..... 236/10
4,512,288 A * 4/1985 Michaud ..... 122/20 B
4,633,821 A * 1/1987 Cleer, Jr. ..... 122/155.2
5,697,330 A * 12/1997 Yetman et al. ..... 122/14.21

FOREIGN PATENT DOCUMENTS

JP 10-306920 11/1998
KR 2000-0000364 1/2000

* cited by examiner

*Primary Examiner*—Jiping Lu
(74) *Attorney, Agent, or Firm*—Cantor Colburn LLP

(57) ABSTRACT

An environmentally-friendly heating apparatus which can collect and recover heat of exhaust gas discharged from a boiler in order to use the heat for heating an indoor space. The heating apparatus filters the exhaust gas, using a mist filter formed by vapor generated in a flue, thereby minimizing the quantity of exhaust fumes containing noxious substances.

12 Claims, 10 Drawing Sheets

HEATING APPARATUS USING USELESS HEAT FOR REDUCING OIL

CROSS REFERENCE TO RELATED APPLICATIONS

This application is a continuation-in-part application of a PCT international application, PCT/KR01/02050, filed on Nov. 27, 2001, which claims priority to Korean Patent Application 2000-71424, filed on Nov. 28, 2000, the PCT international application was published in English on Jun. 6, 2002.

TECHNICAL FIELD

The present invention relates to an environmentally-friendly heating apparatus which can reduce the quantity of fuel used to heat a room, using waste heat recovered from exhaust gas discharged from a boiler, while minimizing the quantity of exhaust fumes containing noxious substances using a mist filter formed by vapor generated in a flue, like as a mist.

BACKGROUND ART

Boilers are well known as representative heating devices. Such boilers are classified into solid fuel boilers (coal or briquette boilers), oil boilers, and gas boilers in accordance with the kind of the used energy source.

Such boilers are used to increase the temperature of an indoor space such as an agricultural hothouse, the interior space of a building, or a boiler room.

Although such a boiler can rapidly increase the temperature of a surrounding space, it has various problems in that a lot of time is taken to sufficiently increase the temperature of the space where it is necessary to heat the entire portion of the space, thereby causing an excessive consumption of the energy source, that is, waste of fuel.

When fuel is burnt in accordance with an operation of the boiler, noxious gas containing noxious substances and fumes are produced. For this reason, there may be a problem in that air pollution occurs as such noxious gas is discharged into the atmosphere without any filtration thereof.

Furthermore, there is waste of fuel because exhaust gas possessing heat is discharged into the atmosphere.

DISCLOSURE OF THE INVENTION

Therefore, the present invention has been made in view of the above mentioned problems, and an object of the invention is to provide a heating apparatus including an elongated flue mounted to an exhaust port provided at a boiler, the flue extending through an indoor space such as a hothouse or a boiler room of a building, and at least one fan unit installed in the flue, and adapted to forcibly circulate exhaust gas, thereby being capable of easily circulating and discharging heat carried by the exhaust gas, so that the exhaust heat can be discharged into the indoor space in the form of heat transferred to the flue and hot water.

Another object of the invention is to provide a heating apparatus including at least one heat concentrator installed at a flue to collect heat from exhaust gas passing through the flue, thereby being capable of discharging the heat of the exhaust gas into the interior of an indoor space in the form of heat transferred to the flue and hot water, and thus rapidly increasing the temperature of the indoor space, so that it is possible to minimize the fuel consumption of a boiler included in the heating apparatus and the amount of fumes.

Another object of the invention is to provide an environmentally-friendly heating apparatus which is configured to filter noxious substances and fumes contained in exhaust gas flowing through a flue, using a mist filter formed by virtue of a temperature difference between the exhaust gas and the flue, and then discharge the filtered fumes while removing contaminated water produced during the filtering process through a water drainage pipe, thereby being capable of minimizing the discharge of noxious substances and fumes.

Another object of the invention is to provide a heating apparatus having a function for supplying, into a hothouse, clean carbon dioxide produced in a flue in accordance with a filtering function in the daytime, through a water drainage pipe adapted to remove contaminated water produced during the filtering process, thereby promoting growth of plants while achieving removal of moisture from the hothouse and ventilation of the hothouse.

Another object of the invention is to provide a heating apparatus including a waste heat controller mounted to the flue and adapted to control the amount of exhaust gas flowing though the flue, in a manual or automatic fashion, thereby being capable of controlling the temperature of the indoor space to be heated.

Another object of the invention is to provide a heating apparatus including a plurality of fan units mounted to an elongated flue, alone or together with a plurality of heat concentrators, in association with a plurality of rooms to be heated, thereby being capable of achieving an efficient circulation of exhaust gas through the flue while obtaining an enhanced heat emission efficiency and an enhanced exhaust efficiency, so that the combustion efficiency and heat emission efficiency of a boiler included the heating apparatus are enhanced.

In order to accomplish these objects, the present invention provides a heating apparatus comprising a boiler adapted to burn an energy source while discharging exhaust gas produced when the energy source is burnt, the boiler including an exhaust port, and a distribution board, the apparatus using waste heat to reduce the consumption of the energy source while being environmentally friendly, further comprising: a distribution pipe connected to the exhaust port of the boiler; at least one flue connected to the distribution pipe, the flue extending through an indoor space, to be heated, while having a discharge port arranged outwardly from the indoor space; and at least one fan unit mounted to the discharge port of the flue and adapted to forcibly outwardly discharge the exhaust gas from the discharge port of the flue.

The heating apparatus may further comprise at least one heat concentrator mounted to the flue and adapted to concentrate heat carried in the exhaust gas passing though the flue, thereby increasing the temperature of the indoor space using the concentrated heat.

BRIEF DESCRIPTION OF THE DRAWINGS

The above objects, and other features and advantages of the present invention will become more apparent after a reading of the following detailed description when taken in conjunction with the drawings, in which.

BEST MODE FOR CARRYING OUT THE INVENTION

Now, the present invention will be described with reference to the annexed drawings.

Figure 1:
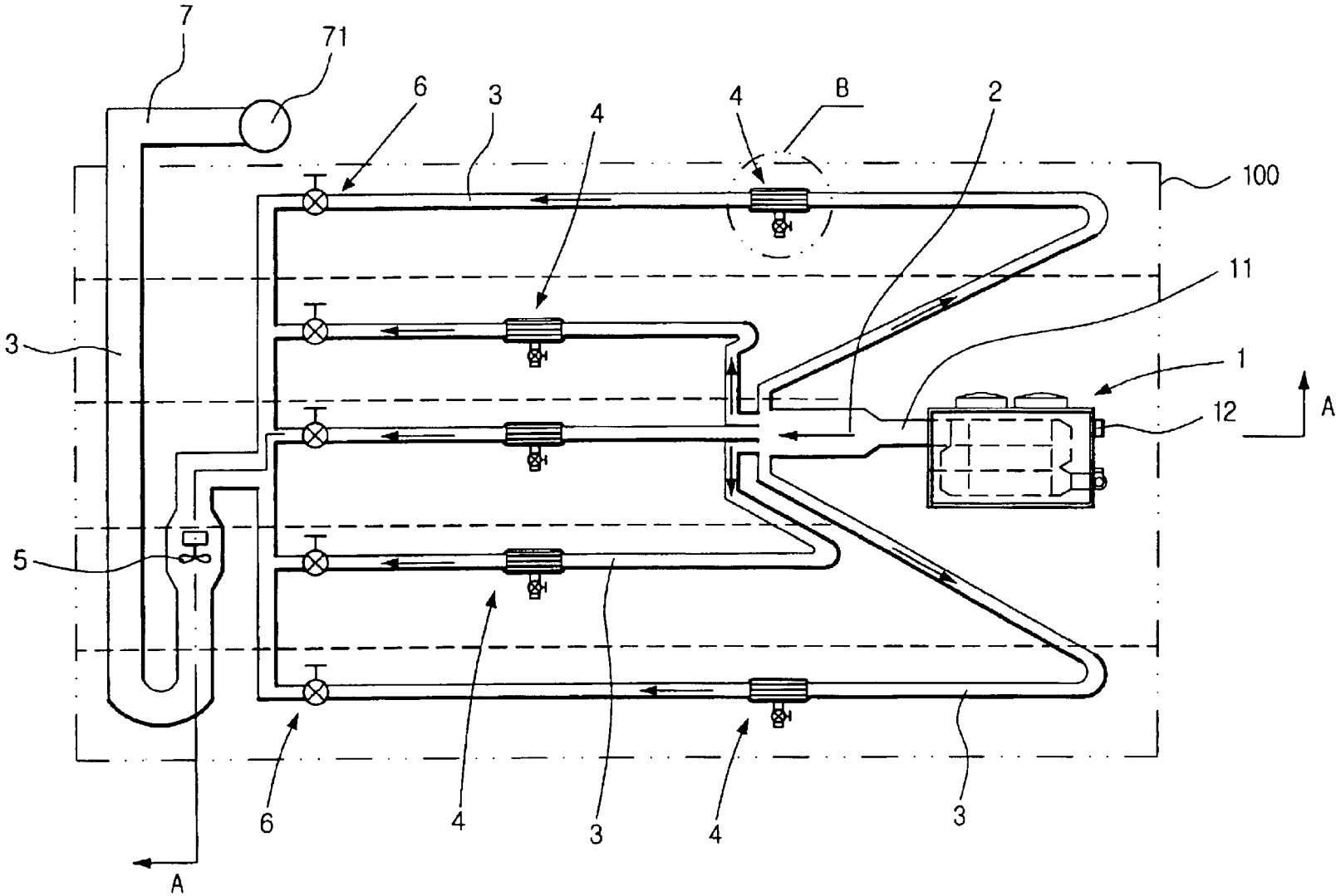
FIG. 1 is a schematic view illustrating a heating apparatus according to an embodiment of the present invention.
Figure 2:
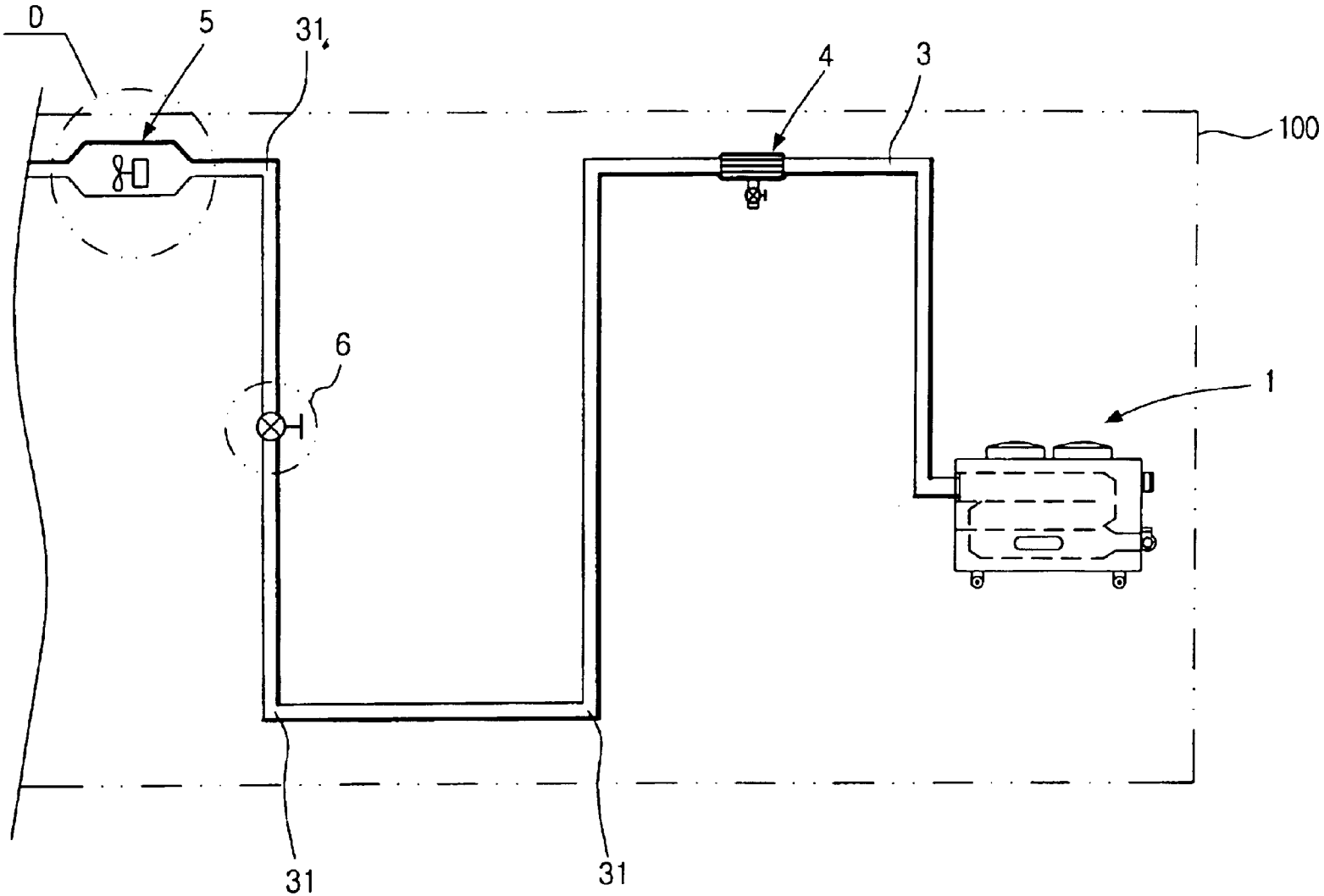
FIG. 2 is a cross-sectional view taken along the line A—A of FIG. 1.

FIG. 1 is a schematic view illustrating a heating apparatus according to an embodiment of the present invention. FIG. 2 is a cross-sectional view taken along the line A—A of FIG. 1. Now, the configuration of the heating apparatus will be described with reference to FIGS. 1 and 2.

As shown in FIGS. 1 and 2, the heating apparatus includes a boiler 1 having a conventional construction adapted to burn an energy source while discharging exhaust gas produced when the energy source is burnt. The boiler 1 includes an exhaust port 11, and a distribution board 12. Connected to the exhaust port 11 of the boiler 1 is at least one flue 3 extending through an indoor space. The flue 3 has a discharge port 31 arranged outwardly from the indoor space. At least one fan unit 5 is installed in the flue 3. The fan unit 5 forcibly moves, through the flue 3, exhaust gas generated from the boiler 1 while containing a large amount of noxious substances, in order to filter the exhaust gas using a mist filter formed in the flue 3 due to a temperature difference between the flue 3 and the exhaust gas, so that the exhaust gas is discharged into the atmosphere in a state of containing a reduced amount of noxious substances.

Where a plurality of flues 3 are used, they may be connected to the exhaust port 11 by a distribution pipe 2 arranged between the flues 3 and the exhaust port 11.

In this case, the distribution pipe 2, which is arranged between the flues 3 and the exhaust port 11 of the boiler 1, has a diameter relatively larger than that of each flue 3. Accordingly, exhaust gas emerging from the distribution pipe 2 can be uniformly distributed to all flues 3 connected to the distribution pipe 2.

At least one water drainage port may be provided at the flue 3.

At least one heat concentrator (radiator) 4 is mounted to the flue 3 in order to concentrate heat carried in the exhaust gas passing though the flue 3, thereby increasing the temperature of the indoor space using the concentrated heat.

In particular, a waste heat controller 6 is detachably mounted to the flue 3 in order to control the amount of exhaust gas flowing though the flue 3, thereby controlling the temperature of the flue 3.

Figure 3:
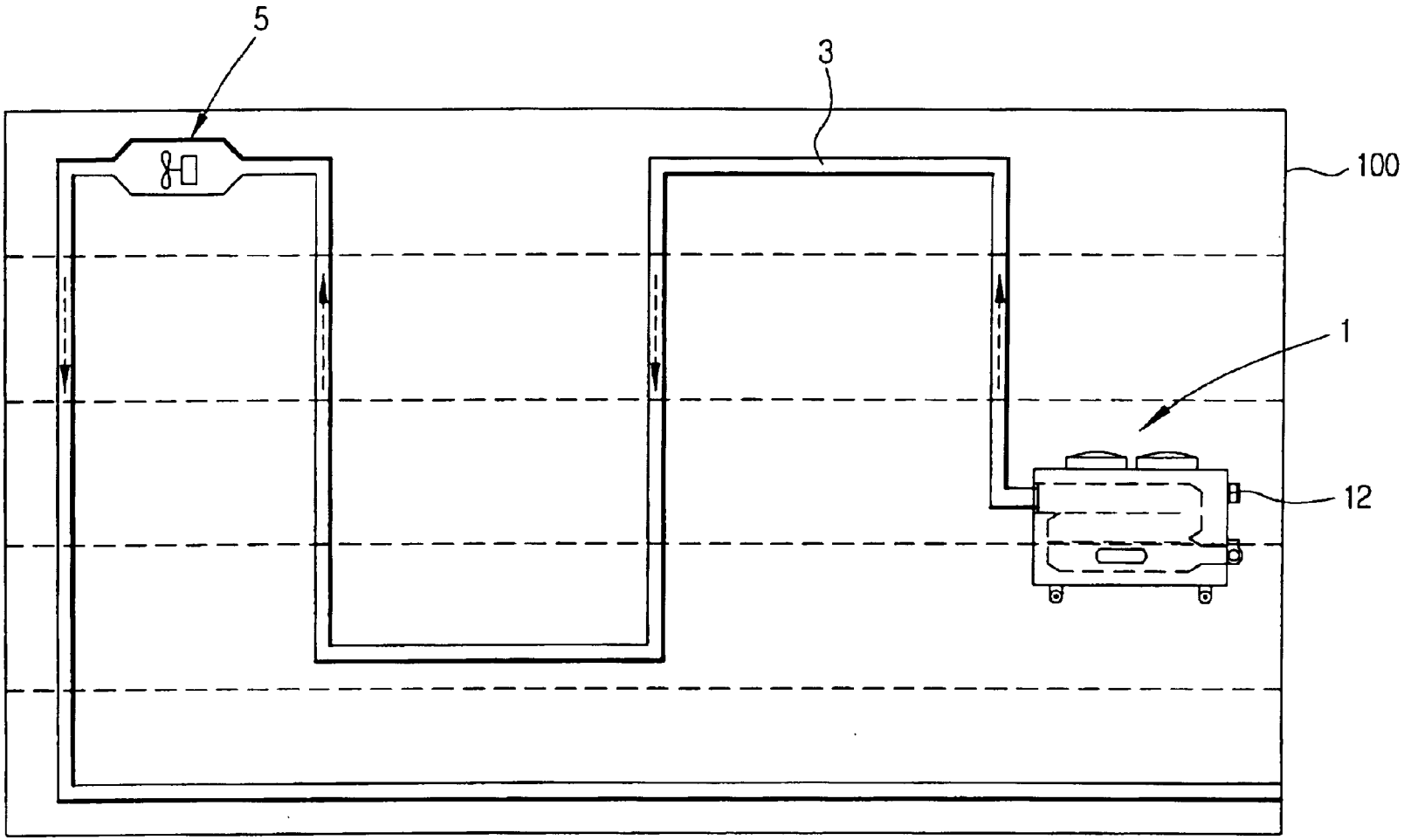
FIG. 3 is a schematic view illustrating a heating apparatus according to another embodiment of the present invention.

Referring to FIG. 3, only one fan unit 5 is provided at the flue 3. This configuration is applicable to one indoor room such as a hothouse (flue type house).

As apparent from the above description, the heating apparatus, which includes the boiler 1 having a conventional construction including an exhaust port 11, and a distribution board 12, and serving to burn an energy source while discharging exhaust gas produced when the energy source is burnt, is characterized by at least one flue 3 connected to the exhaust port 11 of the boiler 1 while extending through an indoor space, the flue 3 having a discharge port 31 arranged outwardly from the indoor space, and at least one fan unit 5 installed in the flue 3, and adapted to forcibly move, through the flue 3, the exhaust gas generated from the boiler 1 while containing a large amount of noxious substances, in order to filter the exhaust gas using a mist filter formed in the flue 3 due to a temperature difference between the flue 3 and the exhaust gas, so that the exhaust gas is discharged into the atmosphere in a state of containing a reduced amount of noxious substances.

Figure 4:
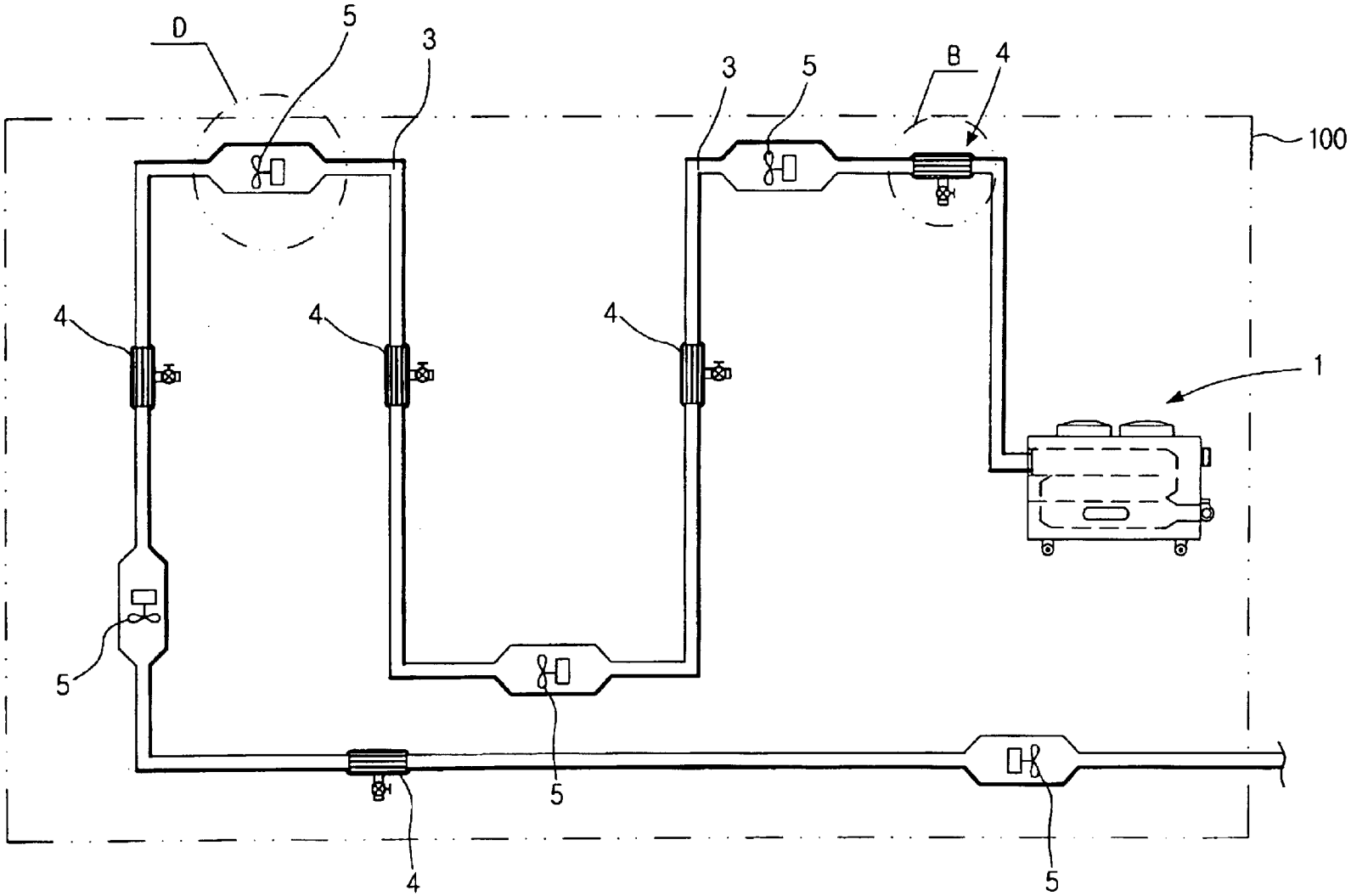
FIG. 4 is a schematic view illustrating a heating apparatus according to another embodiment of the present invention.

FIG. 4 illustrates the case in which a plurality of fan units and/or a plurality of heat concentrators are installed. A plurality of fan units 5 alone may be mounted in the flue 3. In this case, it is possible to maximize the effect of circulating and discharging exhaust gas.

In addition to the fan units 5, a plurality of heat concentrators 4 may be mounted in the flue 3 such that they are uniformly spaced apart from one another.

Thus, where the flue 3 is long, it is possible to increase the heat emission efficiency of the flue 3 by mounting a plurality of fan units 5 to the flue 3, thereby maximizing the effect of circulating and discharging exhaust gas.

That is, the fan units 5 mounted in the flue increase the exhaust efficiency of the flue 3, thereby enhancing the combustion efficiency and heat generation efficiency of the boiler.

Also, the heat concentrators 4, which are mounted in the flue 3 while being uniformly spaced apart from one another, enhance the heat emission efficiency of the flue by concentrating the heat of exhaust gas. Accordingly, it is possible to maximize the effect of increasing the temperature of each indoor space. Of course, such heat concentrators may not be so necessary in the case of a flue type house.

The configuration of the heating apparatus according to the present invention will be described in more detail.

Figure 5:
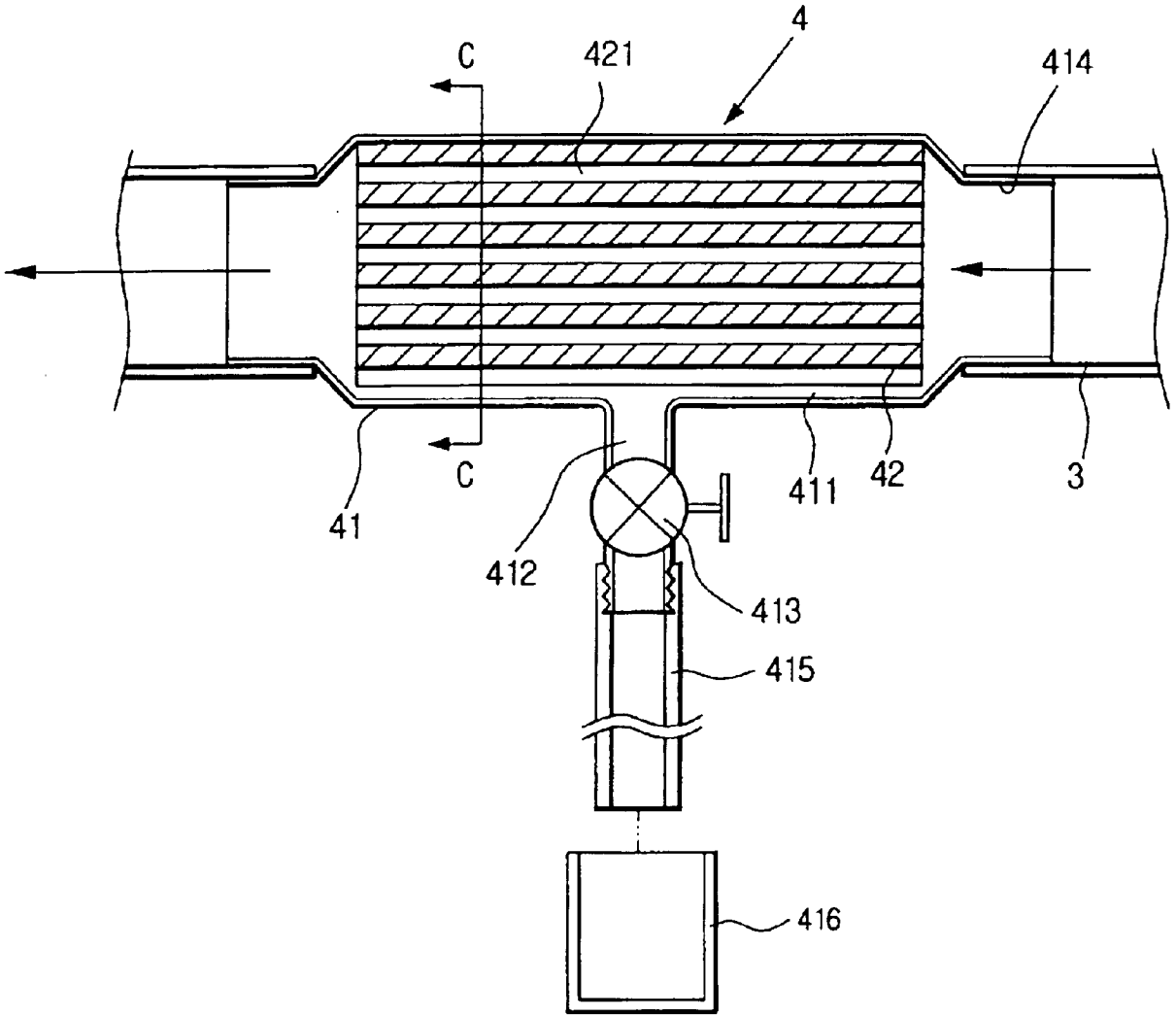
FIG. 5 is an enlarged view corresponding to a portion "B" of FIG. 1 or 4.
Figure 6:
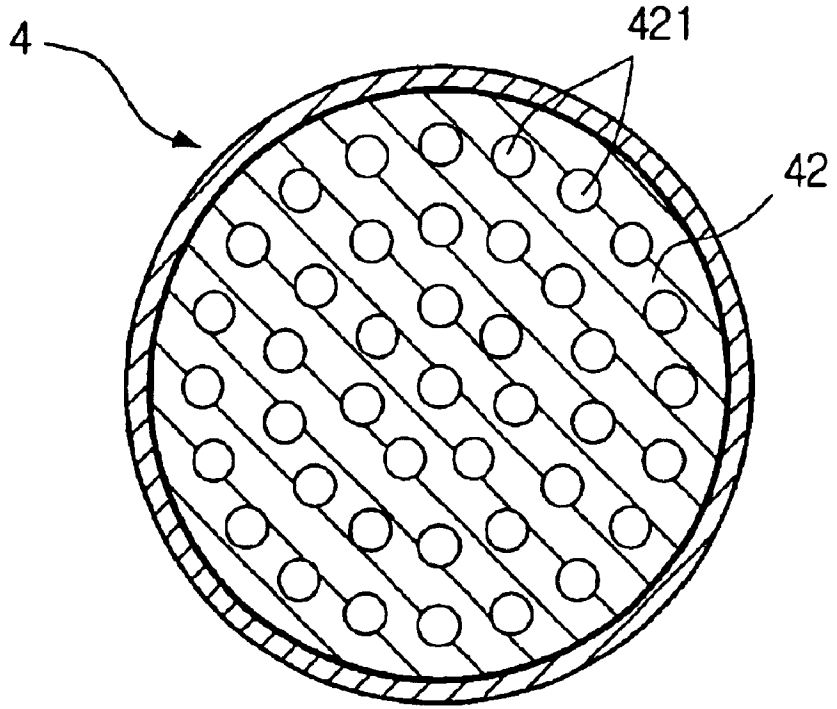
FIG. 6 is a cross-sectional view taken along the line C—C of FIG. 5.

FIG. 5 is an enlarged view corresponding to the portion "B" of FIG. 1 or 4, illustrating one heat concentrator. FIG. 6 is a cross-sectional view taken along the line C—C of FIG. 5. As shown in FIGS. 5 and 6, the heat concentrator 4 includes an enlarged pipe 41 having a diameter larger than that of the flue 3 while being provided at both ends thereof with fitting portions 414 allowing the enlarged pipe 41 to be connected to the flue 3, and a heat concentrating member 42 fitted in the enlarged pipe 41 and formed with a plurality of exhaust gas holes 421.

A water draining portion 411 is provided at the bottom of the enlarged pipe 41. A water drainage pipe 412, which is provided with a valve 413, is connected to the water draining portion 411 of the enlarged pipe 41.

A hose 415 is detachably mounted to a lower end of the water drainage pipe 412 in order to recover water, produced in the flue 3, to a recovery tank 416.

As apparent from the above description, a plurality of heat concentrators 4 may be mounted to the flue 3 in accordance with the size of the indoor space.

Figure 7:
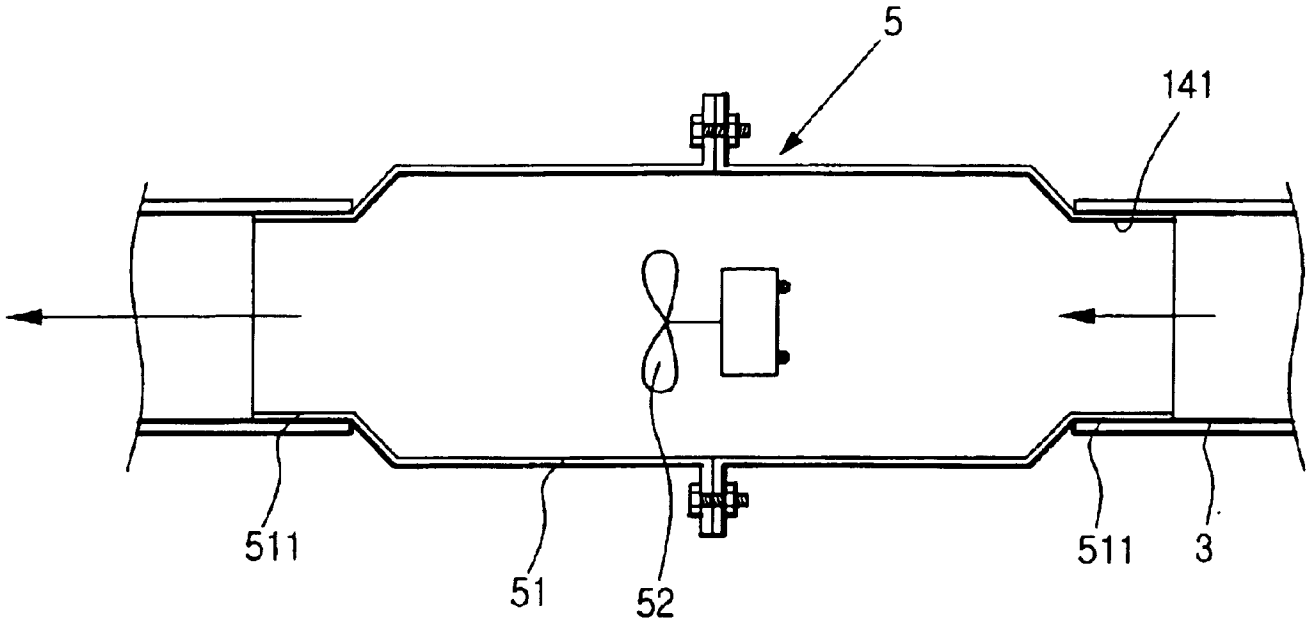
FIG. 7 is an enlarged view corresponding to a portion "D" of FIG. 2 or 4.

FIG. 7 is an enlarged view corresponding to the portion "D" of FIG. 2 or 4, illustrating one fan unit 5. The fan unit 5 includes an enlarged pipe 51 having a diameter larger than that of the flue 3 while being provided at both ends thereof with fitting portions 511 allowing the enlarged pipe to be connected to the flue 3, and a water-proof fan 52 arranged in the enlarged pipe 51 while serving to forcibly circulate exhaust gas existing in the flue 3. The water-proof fan 52 has high resistances to high temperature and moisture.

In particular, the enlarged pipe 51 is divided into two pipe portions coupled to each other by bolts, so as to allow the fan 52 to be installed in the interior of the enlarged pipe 51.

As apparent from the above description, a plurality of fan units 5 may be mounted to the flue 3 in accordance with the size of the indoor space. Since the fan 52 has high resistances to high temperature and moisture, it is possible to prevent the fan from being eroded due to vapor produced, in the form of mist, in the flue 3.

As shown in FIG. 1, a flue extension 7 is connected to the discharge end of the flue 3. The flue extension 7 is adapted to extend through the interior of an outdoor rest room 71, so as to heat the outdoor rest room 71.

In addition, the flue 3 includes a plurality of bent portions 31 in order to obtain an increased surface area, as shown in FIGS. 2 and 4. Accordingly, it is possible to maximize the heating efficiency of the heating apparatus.

In FIGS. 1 to 4, the reference numeral 100 denotes the indoor space where the heating apparatus of the present invention is installed.

Now, the operation of the heating apparatus having the above described configuration according to the present invention will be described.

When the boiler 1 operates, fuel is burnt, thereby producing exhaust gas. The produced exhaust gas is introduced into the distribution pipe 2 via the exhaust port 11 of the boiler 1, and then introduced into the flue 3 communicating with the distribution pipe 2 by at least one fan unit 5 which, in turn, forces the exhaust gas to pass through the flue 3.

The exhaust gas introduced into the flue 3 passes through the flue 3 in accordance with the operation of the fan unit 5 installed in the flue 3, as shown in FIGS. 5 and 6. As the exhaust gas passes through the flue 3, it discharges heat via the flue 3, thereby increasing the temperature of the indoor space 100.

Meanwhile, since at least one heat concentrator 4 is installed in the flue 3, the heat carried in the exhaust gas is collected by the heat concentrator (radiator) 4. The heat collected by the heat concentrator 4 is transferred to the flue 3, thereby increasing the temperature of the indoor space 100.

That is, when exhaust gas passes through the exhaust gas holes 421 of the heat concentrating member 42, its heat is transferred to the heat concentrating member 42, thereby increasing the temperature of the heat concentrating member 42. Thus, the heat emission effect of the flue 3 is enhanced.

When the exhaust gas passes through the flue 3, vapor may be instantaneously produced in the form of mist because the temperature of the flue 3 is lower than the temperature of the exhaust gas. That is, such vapor serves as a mist filter.

By such a mist filter, various foreign matters contained in the fumes and exhaust gas passing through the flue are filtered.

The moisture of the mist filter used in the filtering operation is removed from the flue 3 via the water drainage pipe 412. Accordingly, it is possible to minimize the discharge amount of noxious gas and fumes contained in the exhaust gas.

In addition to the draining of water, the water drainage pipe 412 also serves to discharge clean carbon dioxide capable of promoting growth of plants in the daytime. The water drainage pipe 412 can also achieve an enhancement in air ventilation efficiency. Although clean carbon dioxide helps to promote growth of plants in the daytime, it serves to degrade the growth of plants after sunset. Accordingly, the valve 413 of the water drainage pipe 412 is opened only in the daytime, in order to supply carbon dioxide to the interior of a hothouse via the water drainage pipe 412.

As shown in FIG. 1, the waste heat controller 6, which is mounted to the flue 3, controls the amount of exhaust gas flowing though the flue 3, thereby controlling the temperature of each indoor space to be heated. An automatic sensor may also be provided to allow the exhaust gas to pass through the flue 3 in a repeated fashion. Accordingly, the mist filter can be repeatedly formed in accordance with the temperature of the exhaust gas higher than the temperature of the flue 3. Thus, the exhaust gas is discharged into the atmosphere in a filtered state.

In addition to hothouses, the heating apparatus according to the present invention can also be applied to boiler rooms of buildings (for example, factories, offices, or apartments) in order to minimize the consumption of fuel while minimizing the amount of noxious substances and fumes contained in exhaust gas.

Figure 8:
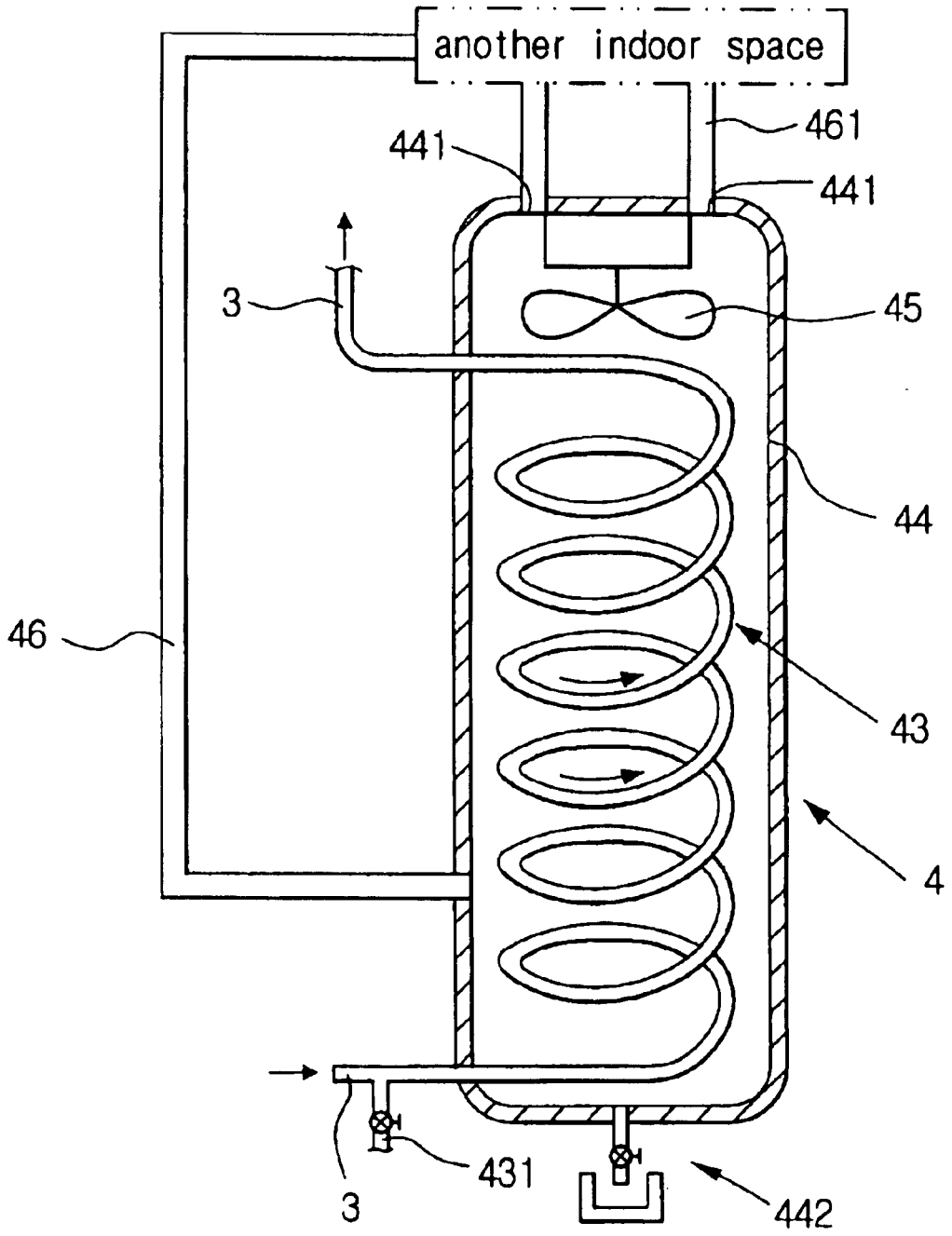
FIG. 8 is a sectional view illustrating a heat concentrator according to another embodiment of the present invention.

FIG. 8 is a sectional view illustrating a heat concentrator according to another embodiment of the present invention. As shown in FIG. 8, the heat concentrator, which is denoted by the reference numeral 4, includes a vertical helical flue portion 43 formed by helically bending a desired portion of the flue 3, a heat collecting vessel 44 extending vertically while surrounding the helical flue portion 43 and having air inlet holes 441 at its top portion, a fan 45 mounted to the top portion of the heat collecting vessel 44 while being arranged above the helical flue portion 43 in the interior of the heat collecting vessel 44, an air feeding pipe 46 connected to the heat collecting vessel 44 and adapted to feed air existing in the heat collecting vessel 44 to another indoor space, and indoor air introducing pipes 461 respectively connected to the air inlet holes 441 in order to introduce the air of the another indoor space into the heat collecting vessel 44.

A water drainage pipe 431 is connected to the lower end of the helical flue portion 43 so as to drain water produced in the flue 3. The water drainage pipe 431 is opened and closed in accordance with operations of a valve installed therein.

Another water drainage pipe 442, which is provided with a valve, is connected to the bottom of the heat collecting vessel 44 so as to drain water collected in the heat collecting vessel 44.

Since the helical flue portion 43 of the flue 3 is arranged in the heat collecting vessel 44, the air existing in the heat collecting vessel 44 is effectively increased. Accordingly, a desired heat collecting effect is obtained. Thus, the temperature of the another indoor space can be rapidly increased.

In addition, the heat collecting vessel 44 receives the internal air of the another indoor space, and then feeds the received air into the air feeding pipe 46 by the fan 45. Accordingly, it is possible to feed hot air to another indoor space connected to the air feeding pipe 46.

Figure 9:
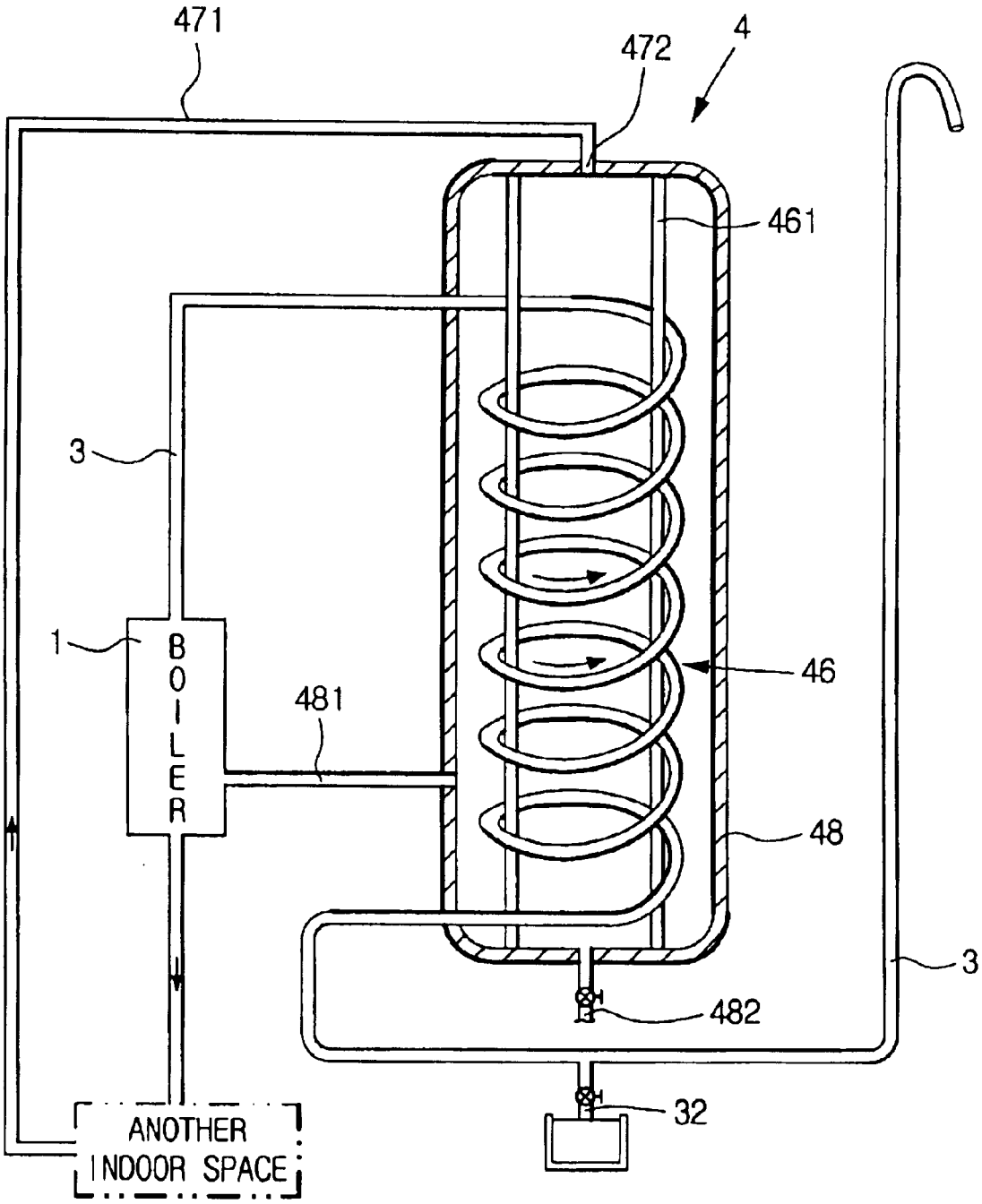
FIG. 9 is a sectional view illustrating a heat concentrator according to another embodiment of the present invention.

FIG. 9 is a sectional view illustrating a heat concentrator according to another embodiment of the present invention. As shown in FIG. 9, the heat concentrator, which is denoted by the reference numeral 4, includes a vertical helical flue portion 46 formed by helically bending a desired portion of the flue 3 around support members 461 extending vertically in a warming water tank 48. The warming water tank 48 is also included in the heat concentrator 4. The warming water tank 48 extends vertically while surrounding the helical flue portion 46. The warming water tank 48 is provided at the top thereof with a warming water inlet hole 472 connected with a warming water pipe 471 extending from another indoor space, and supplying a warming water cooled while passing through the another indoor space. The warming water tank 48 is also connected to a warming water supply pipe 481 adapted to supply the warming water heated by the helical flue portion 46 in the warming water tank 48. The warming water tank 48 is also connected at the bottom thereof with a water drainage pipe 482 opened and closed in accordance with operations of a valve installed therein. The heat concentrator 4 further includes a water drainage pipe 32 connected to the flue 3, and opened and closed in accordance with operations of a valve installed therein.

In accordance with this configuration, warming water, which passes through the boiler 1 and the indoor space, is heated by the heat emitted from the flue 3. Accordingly, it is possible to minimize the fuel loss of the boiler 1.

That is, the warming water, which is cooled while passing through the indoor space, is heated by the heat emitted from the flue 3, and subsequently re-introduced into the boiler 1. Accordingly, it is possible to increase the temperature of the warming water in the boiler 1 with a reduced quantity of heat generated in accordance with combustion of fuel.

Figure 10:
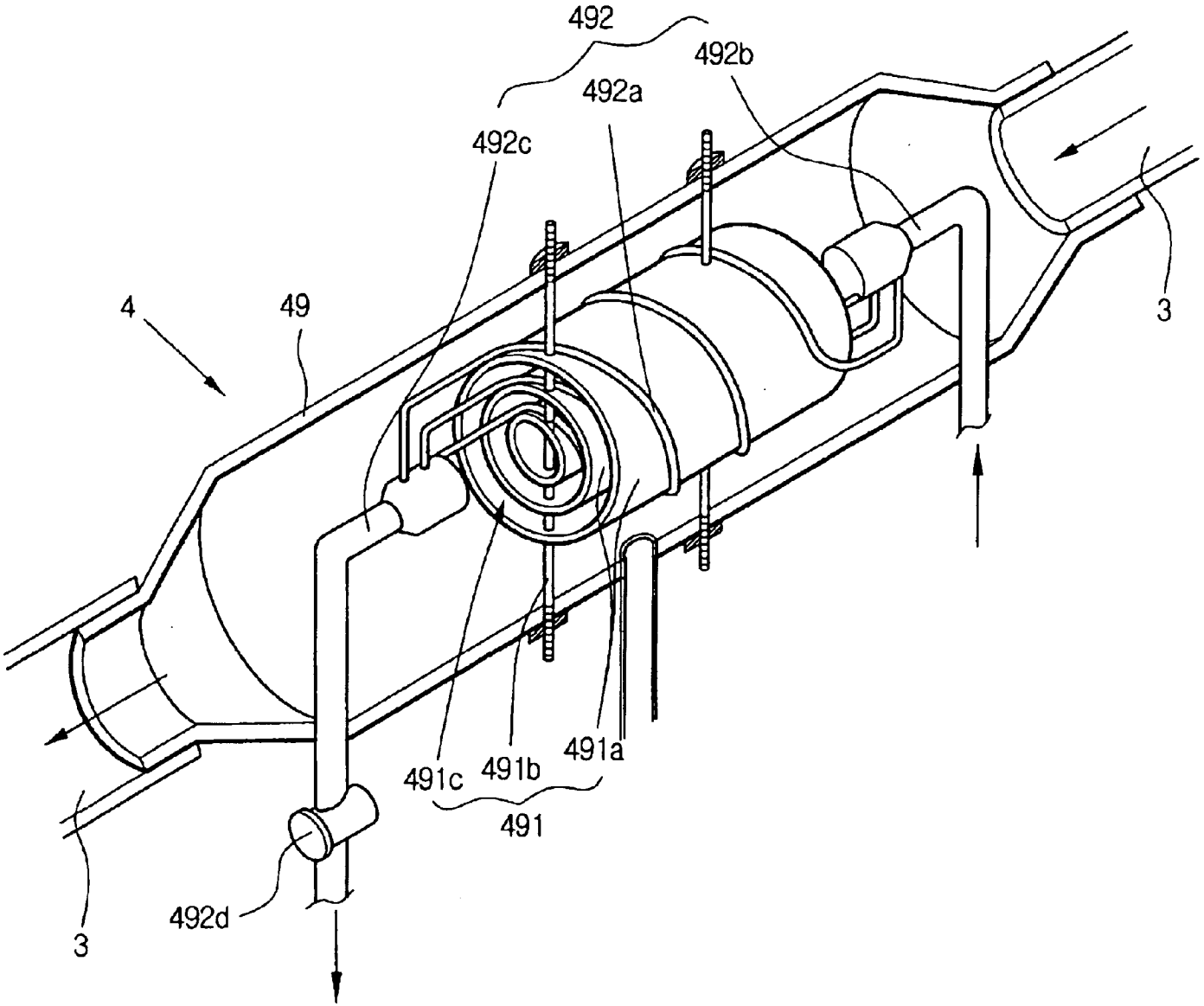
FIG. 10 is a sectional view illustrating a heat concentrator according to another embodiment of the present invention.

FIG. 10 is a sectional view illustrating a heat concentrator according to another embodiment of the present invention. As shown in FIG. 10, the heat concentrator, which is denoted by the reference numeral 4, includes an enlarged pipe 49 having a diameter larger than that of the flue 3 while being provided at both ends thereof with fitting portions allowing the enlarged pipe 49 to be connected to the flue 3, and a heat collecting unit 491 including a plurality of concentric cylindrical pipes 491*a* concentrically arranged in the enlarged pipe 49 in such a fashion that an exhaust gas passage 491*c* is defined between adjacent ones of the cylindrical pipes 491*a*. The concentric cylindrical pipes 491*a* are fixedly mounted in the enlarged pipe 49 by at least one support bar 491*b* extending diametrically throughout the enlarged pipe 49. The heat concentrator 4 also includes a water circulating unit 492 including a plurality of spiral branch pipes 492*a* each extending spirally around an associated one of the concentric cylindrical pipes 492*a* to heat water supplied thereto, a water supply pipe 492*b* connected to the spiral branch pipes 492*a* to supply water into the spiral branch pipes 492*a*, a water sucking pipe 492*c* connected to the spiral branch pipes 492*a* to suck hot water from the spiral branch pipes 492*a*, and a water circulating pump 492*d* connected to the water sucking pipe 492*a*.

Water introduced into the water circulating unit 492 is branched into a plurality of water flows through the spiral branch pipes 492*a*, and then merged into one water flow while being introduced into the water sucking pipe 492*c*, so that it is re-used as hot water for the boiler. Accordingly, it is possible to minimize the waste of fuel in the boiler.

Also, the hot water obtained in the above described fashion can be used for a warming purpose. Accordingly, it is possible to obtain a desired warming effect with a reduced quantity of fuel.

INDUSTRIAL APPLICABILITY

As apparent from the above description, the present invention provides a heating apparatus which is configured to forcibly circulate exhaust gas flowing in a flue extending through an indoor space such as a hothouse or a boiler room of a building, thereby enhancing the circularity of the exhaust gas in order to increase the effect of heating the indoor space.

In accordance with the present invention, at least one heat concentrator (radiator) is installed at the flue in order to enhance the discharge efficiency of the exhaust gas, thereby maximizing the effect of heating the indoor space.

The present invention also provides a heating apparatus which is configured to discharge heat carried in exhaust gas and hot water into diverse indoor spaces, thereby rapidly increasing the temperature of each indoor space while minimizing the consumption of fuel.

The present invention also provides an environmentally-friendly heating apparatus which is configured to filter noxious substances and fumes contained in exhaust gas flowing through a flue, using a mist filter formed by virtue of a temperature difference between the exhaust gas and the flue, thereby minimizing the discharge of noxious substances and fumes.

The present invention also provides a function for supplying, into a hothouse, clean carbon dioxide produced in the flue in accordance with the filtering function in the daytime, thereby promoting growth of plants.

A waste heat controller may be mounted to the flue in order to control the amount of exhaust gas flowing though the flue, and the amount of hot water. In this case, it is possible to control the temperature of the indoor space to be heated. Also, noxious substances and fumes contained in exhaust gas can be effectively filtered, so that it is also possible to prevent the atmosphere from being contaminated.

The heating apparatus may include a plurality of heat concentrators and a plurality of fan units mounted to the flue. In this case, it is possible to obtain an enhanced heat emission efficiency and an enhanced exhaust efficiency. Accordingly, the heating apparatus can be applied to a larger indoor space. In the case of a flue type house having a large space, such heat concentrators may be dispensed to obtain enhanced effects.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A heating apparatus comprising a boiler adapted to burn an energy source white discharging exhaust gas produced when the energy source is burnt, the boiler including an exhaust port, and a distribution board, the apparatus using waste heal to reduce the consumption of the energy source while being environmentally friendly, further comprising:

at least one flue connected to the exhaust port of the boiler, the flue extending through an indoor space, and having a discharge port arranged outwardly from the indoor space;

at least one fan unit installed in the flue, the fan including:

an enlarged pipe having a diameter larger than that of the flue while being provided at both ends thereof with fitting portions allowing the enlarged pipe to be connected to the flue, the enlarged pipe being divided into two pipe portions coupled to each other by bolts; and a fan arranged in the enlarged pipe while serving to forcibly circulate exhaust gas existing in the flue, the fan having high resistance to high temperature and moisture, while thereby discharging the exhaust gas into an atmosphere after filtering the exhaust gas to contain a reduced amount of noxious substances, using a mist filter formed in the flue due to a temperature difference between the flue and the exhaust gas, or without any filtration of the exhaust gas by the mist filler; and at least one water drainage port provided at the line.

2. The heating apparatus according to claim 1, further comprising:

a distribution pipe arranged between the flue and the exhaust port, the distribution pipe having a diameter relatively larger than that of the flue.

3. The heating apparatus according to claim 2, further comprising:

at least one heat concentrator mounted to the flue, and adapted to concentrate heat carried in the exhaust gas passing though the flue, thereby increasing a temperature of the indoor space using the concentrated heat.

4. The heating apparatus according to claim 2, wherein the flue has a plurality of bent portions, and the fan unit is electrically connected to the distribution board so that it is operationally connected to the boiler.

5. The heating apparatus according to claim 1, further comprising:

at least one heat concentrator mounted to the flue, and adapted to concentrate heat carried in the exhaust gas passing though the flue, thereby increasing a temperature of the indoor space using the concentrated heat.

6. The heating apparatus according to claim 5, further comprising:

a waste heat concentrator comprises to the flue, and adapted to control a temperature of the flue, the waste heat controller functioning to control an amount of the exhaust gas flowing through the flue, thereby forming a mist filter, so that the exhaust gas is discharged after being filtered.

7. The heating apparatus according to claim 5, wherein:

the at least one heat concentrator comprises a plurality of heat concentrators mounted to the flue while being uniformly spaced from one another along the flue; and the at least one fan unit comprises a plurality of fan units mounted to the flue so that each of the fan units is arranged between adjacent ones of the heat concentrators.

8. The heating apparatus according to claim 5, wherein the heat concentrator comprises an enlarged pipe having a diameter larger than that of the flue while being provided at both ends thereof with fitting portions allowing the enlarged pipe to be connected to the flue, and a heat concentrating member fitted in the enlarged pipe and formed with a plurality of exhaust gas holes, further comprising:

a water draining portion provided at a bottom of the enlarged pipe;

a water drainage pipe connected to the water draining portion, the water drainage pipe being opened and closed in accordance with operations of a valve installed therein; and a hose detachably mounted to a lower end of the water drainage pipe and adapted to recover water, produced in the flue, to a recovery tank.

9. The heating apparatus according to claim 5, wherein the heat concentrator comprises a vertical helical flue portion formed by helically bending a desired portion of the flue, a heat collecting vessel extending vertically while surrounding the helical flue portion and having air inlet holes at a top portion thereof, a fan mounted to the top portion of the heat collecting vessel while being arranged above the helical flue portion in the interior of the heat collecting vessel, an air feeding pipe connected to the heat collecting vessel and adapted to feed hot air existing in the heat collecting vessel to another indoor space, indoor air introducing pipes respectively connected to the air inlet holes, and adapted to introduce air from the another indoor space into the heat collecting vessel 44, and a water drainage pipe connected to a bottom of the heat collecting vessel, and adapted to drain water collected in the heat collecting vessel, the water drainage pipe being provided with a valve, further comprising:

a water drainage pipe connected to a lower end of the helical flue portion and adapted to drain water produced in the flue, the water drainage pipe being opened and closed in accordance with operations of a valve installed therein.

10. The heating apparatus according to claim 5, wherein the heat concentrator comprises:

a vertical helical flue portion formed by helically bending a portion of the flue around support members extending vertically in a warming water tank;

the warming water tank extending vertically while surrounding the helical flue portion, the warming water tank having a warming water inlet hole formed at a top of the warming water tank, and connected with a warming water pipe extending from another indoor space to supply a warming water cooled while passing through the another indoor space, a warming water supply pipe adapted to supply the warming water heated by the helical flue portion in the warming water tank, and a water drainage pipe formed at a bottom of the warming water tank, and adapted to be opened and closed in accordance with operations of a valve installed therein; and a water drainage pipe connected to the flue, and adapted to be opened and closed in accordance with operations of a valve installed therein.

11. The heating apparatus according to claim 5, wherein the heat concentrator comprises:

an enlarged pipe having a diameter larger than that of the flue while being provided at both ends thereof with fitting portions allowing the enlarged pipe to be connected to the flue;

a heat collecting unit including a plurality of concentric cylindrical pipes concentrically arranged in the enlarged pipe, and fixedly mounted in the enlarged pipe by at least one support bar extending diametrically throughout the enlarged pipe, adjacent ones of the concentric cylindrical pipes defining an exhaust gas passage therebetween; and a water circulating unit including a plurality of spiral branch pipes each extending spirally around an associated one of the concentric cylindrical pipes to heat water supplied thereto, a water supply pipe connected to the spiral branch pipes to supply water into the spiral branch pipes, a water sucking pipe connected to the spiral branch pipes to suck hot water from the spiral branch pipe, and a water circulating pump connected to the water sucking pipe.

12. The heating apparatus according to claim 1, wherein the flue has a plurality of bent portions, and the fan unit is electrically connected to the distribution board so that it is operationally connected to the boiler.

* * * * *